United States Patent [19]

Persaud et al.

[11] Patent Number: 5,071,114

[45] Date of Patent: Dec. 10, 1991

[54] ARTIFICIAL LIMB APPARATUS

[76] Inventors: Sooknanan Persaud; Jasoda Jairam, both of 810 S. Woodlynn Rd., Baltimore, Md. 21221

[21] Appl. No.: 622,544

[22] Filed: Dec. 5, 1990

[51] Int. Cl.[5] ..... A41D 1/00

[52] U.S. Cl. ..... 272/8 N; 623/57

[58] Field of Search ..... 272/8 R, 8 N, 27 R, 272/27 N; 623/57

[56] References Cited

U.S. PATENT DOCUMENTS 2,453,604 11/1948 Tenenbaum ..... 623/57 X 2,657,394 11/1953 Milton, Jr. et al. ..... 623/57

4,846,843 7/1989 Gammer ..... 623/57

*Primary Examiner*—Richard E. Chilcot, Jr.

*Attorney, Agent, or Firm*—Leon Gilden

[57] ABSTRACT

An apparatus is arranged for slidingly mounting over an individual's natural limb to include a tubular sleeve member, including a hand portion mounted at a forward end thereof. The sleeve member is arranged to include an inner and outer tube, with the outer tube of porous construction to excrete an itemized fluid perfume mixture directed into pneumatic chamber defined between the inner and outer tube of the organization. A pump member is arranged to direct the itemized fluid through a fluid conduit into the chamber.

3 Claims, 3 Drawing Sheets

PRIOR ART

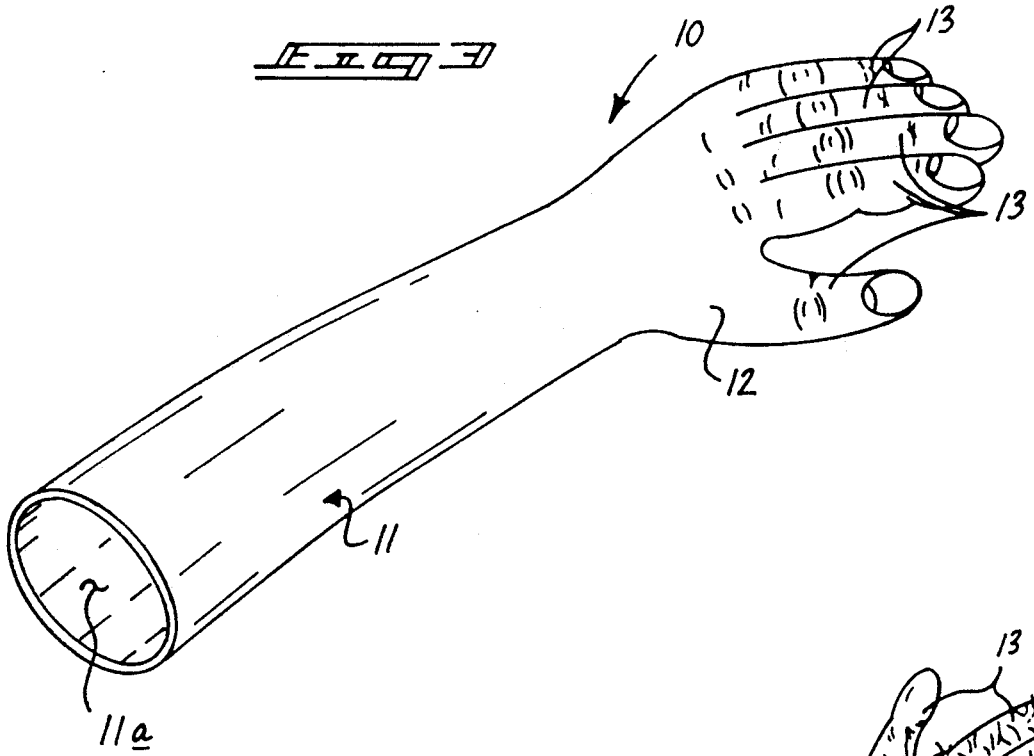
Fig 3
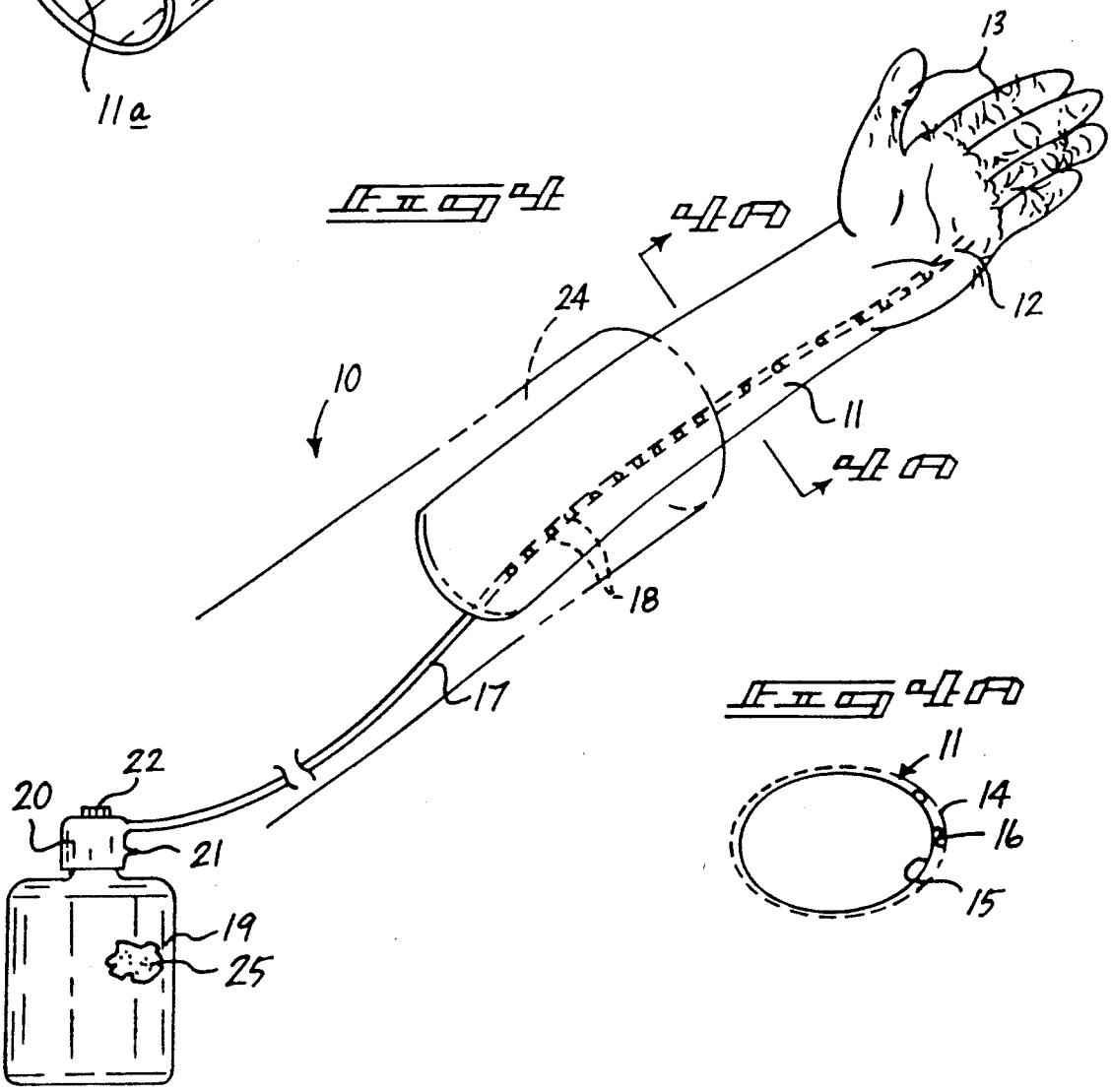
Fig 4
Fig 4A

ARTIFICIAL LIMB APPARATUS

BACKGROUND OF THE INVENTION

1. Field of the Invention

The field of invention relates to artificial limb construction, and more particularly pertains to a new and improved artificial limb apparatus wherein the same is arranged for mounting upon an individual's hand as a novelty device.

2. Description of the Prior Art

As a novelty or for use by various celebrities and the like for relative hand shakes and grasping, the instant invention attempts to overcome deficiencies of the prior art by providing a sleeve construction arranged to provide protection and effect exuding of a perfume scent through the apparatus in use.

Examples of prior art limb constructions may be found in U.S. Pat. No. 4,824,097 to Axtell wherein an artificial limb member is mounted to an individual's natural limb to provide an illusionary device, wherein the natural limb mounts a puppet and the artificial limb effects an illusion of portraying the natural limb.

U.S Pat. No. 4,685,929 to Monestier sets forth a hand prostheses device formed of flexible material.

U.S. Pat. No. 4,792,338 to Rennerfelt, and U.S. Pat. No. 4,208,830 to Yoshida are further examples of mechanical and artificial hand constructions.

As such, it may be appreciated that there continues to be a need for a new and improved artificial limb apparatus as set forth by the instant invention which addresses both the problems of ease of use as well as effectiveness in construction in effecting protective covering and exuding fluid in use of the organization and in this respect, the present invention substantially fulfills this need.

SUMMARY OF THE INVENTION

In view of the foregoing disadvantages inherent in the known types of artificial limb apparatus now present in the prior art, the present invention provides an artificial limb apparatus wherein the same provides a protective covering for selective use by individuals. As such, the general purpose of the present invention, which will be described subsequently in greater detail, is to provide a new and improved artificial limb apparatus which has all the advantages of the prior art artificial limb apparatus and none of the disadvantages.

To attain this, the present invention provides an apparatus arranged for slidably mounting over an individual's natural limb to include a tubular sleeve member, including a hand portion mounted at a forward end thereof. The sleeve member is arranged to include an inner and outer tube, with the outer tube of porous construction to excrete an itemized fluid perfume mixture directed into an pneumatic chamber defined between the inner and outer tube of the organization. A pump member is arranged to direct the itemized fluid through a fluid conduit into the chamber.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved artificial limb apparatus which has all the advantages of the prior art artificial limb apparatus and none of the disadvantages.

It is another object of the present invention to provide a new and improved artificial limb apparatus which may be easily and efficiently manufactured and marketed It is a further object of the present invention to provide a new and improved artificial limb apparatus which is of a durable and reliable construction.

An even further object of the present invention is to provide a new and improved artificial limb apparatus which is susceptible of a low cost of manufacture with regard to both materials and labor, and which accordingly is then susceptible of low prices of sale to the consuming public, thereby making such artificial limb apparatus economically available to the buying public.

Still yet another object of the present invention is to provide a new and improved artificial limb apparatus which provides in the apparatuses and methods of the prior art some of the advantages thereof, while simultaneously overcoming some of the disadvantages normally associated therewith.

Still another object of the present invention is to provide a new and improved artificial limb apparatus wherein the same effects an illusionary covering of an individual's forearm and hand portion to simulate the hand to protect the hand during repetitive grasping of others in hand shaking and the like.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 3 is an isometric illustration of the instant invention.

FIG. 4 is an isometric illustration of the instant invention mounted relative to a shirt sleeve portion and an applicator pump utilized by the instant invention.

FIG. 4*a* is an orthographic view, taken along the lines 4*a*–4*a* of FIG. 4 in the direction indicated by the arrows.

DESCRIPTION OF THE PREFERRED EMBODIMENT

Figure 1:
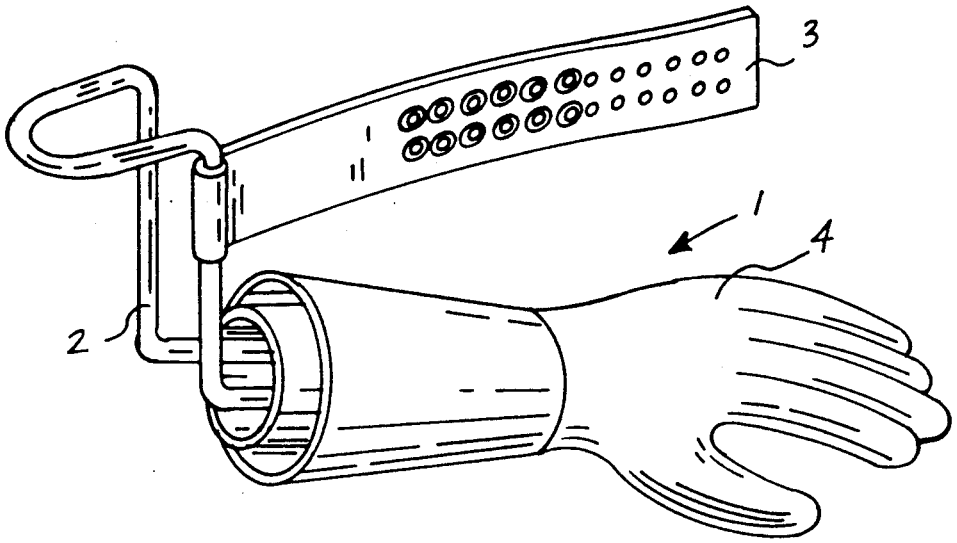
FIG. 1 is an isometric illustration of a prior art artificial hand construction.

With reference now to the drawings, and in particular to FIGS. 1 to 5 thereof, a new and improved artificial limb apparatus embodying the principles and concepts of the present invention and generally designated by the reference numeral 10 will be described.

Figure 2:
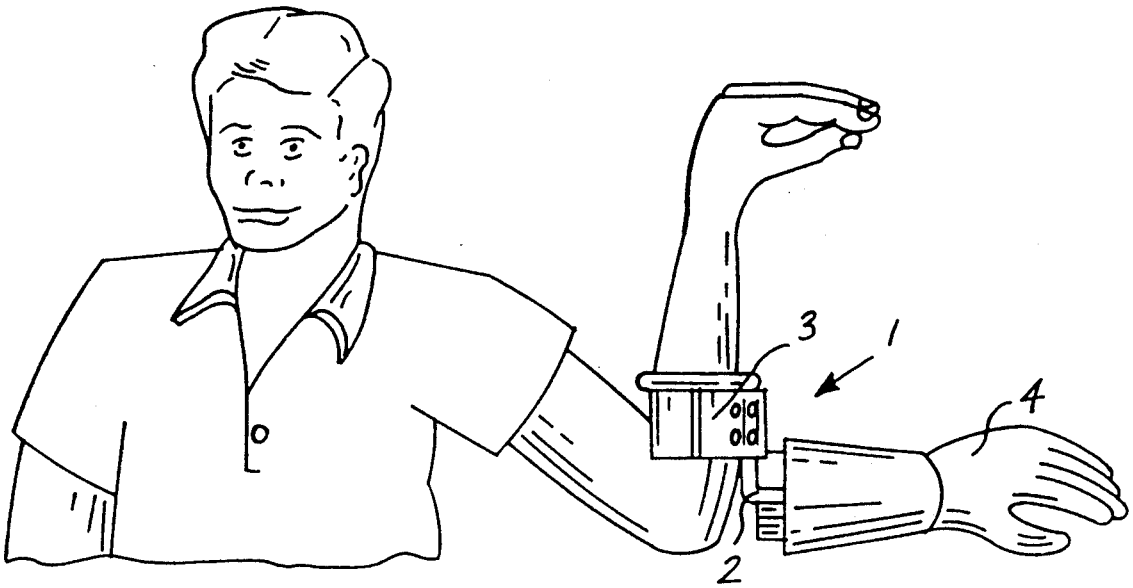
PRIOR ART FIG 2
FIG. 2 is an orthographic side view, taken in elevation, of the prior art device as set forth in FIG. 1 mounted to an individual.

FIG. 1 illustrates a prior art limb construction 1, wherein a generally "S" shaped bracket 2 includes a strap structure 3 to mount the artificial limb portion 4 somewhat orthogonally relative to an individual's natural limb, as illustrated in FIG. 2 and as set forth in U.S. Pat. No. 4,824,097.

More specifically, the artificial limb apparatus 10 of the instant invention essentially comprises a tubular sleeve member 11 formed of a flexible memory retentent material coaxially aligned, including an entrance opening 11*a* at the first end, and a hand portion 12 mounted at the other end formed with a series of flexible finger members 13. FIG. 4 sets forth the sleeve member 11 formed with an outer tube 14 coextensively arranged about an inner tube 15. The outer tube 14 is of a porous construction, with the inner tube 15 formed of a fluid impermeable polymeric material. A pneumatic chamber 16 is thereby defined between the inner and outer tubes 15 and 14 respectively, with the pneumatic chambers 16 extending coextensively throughout the tubular sleeve member 11 and the hand portion 12. A pneumatic conduit 17 is directed throughout the pneumatic chamber 16, with a pneumatic conduit 17 including a series of conduit apertures 18 formed in the pneumatic conduit within the pneumatic chamber 16. A pressurized pneumatic container 19 includes a securement cap 20 formed with a securement cap removably mounted reactive to the container. The securement cap 20 includes a pneumatic refill valve 21 to permit pneumatic pressurization of the container 19, and a release button valve 22 arranged to direct an atomized mixture formed within the container 19 throughout the pneumatic conduit 17 and into the pneumatic chamber 16 and thereafter through the porous outer tube 14. To this end, the pneumatic container 19 is filled with a scented fluid 25 that is atomized upon pressurizing of the container 19 and dispensed through the conduit 17 into the chamber 16 during use. In this manner, the atomized fluid is of a scented character to effect a scenting or perfuming within the chamber 16 and to direct the scent through the outer tube 14 during use to provide an enhanced pleasant aroma to be directed from the artificial limb apparatus 10.

Figure 5:
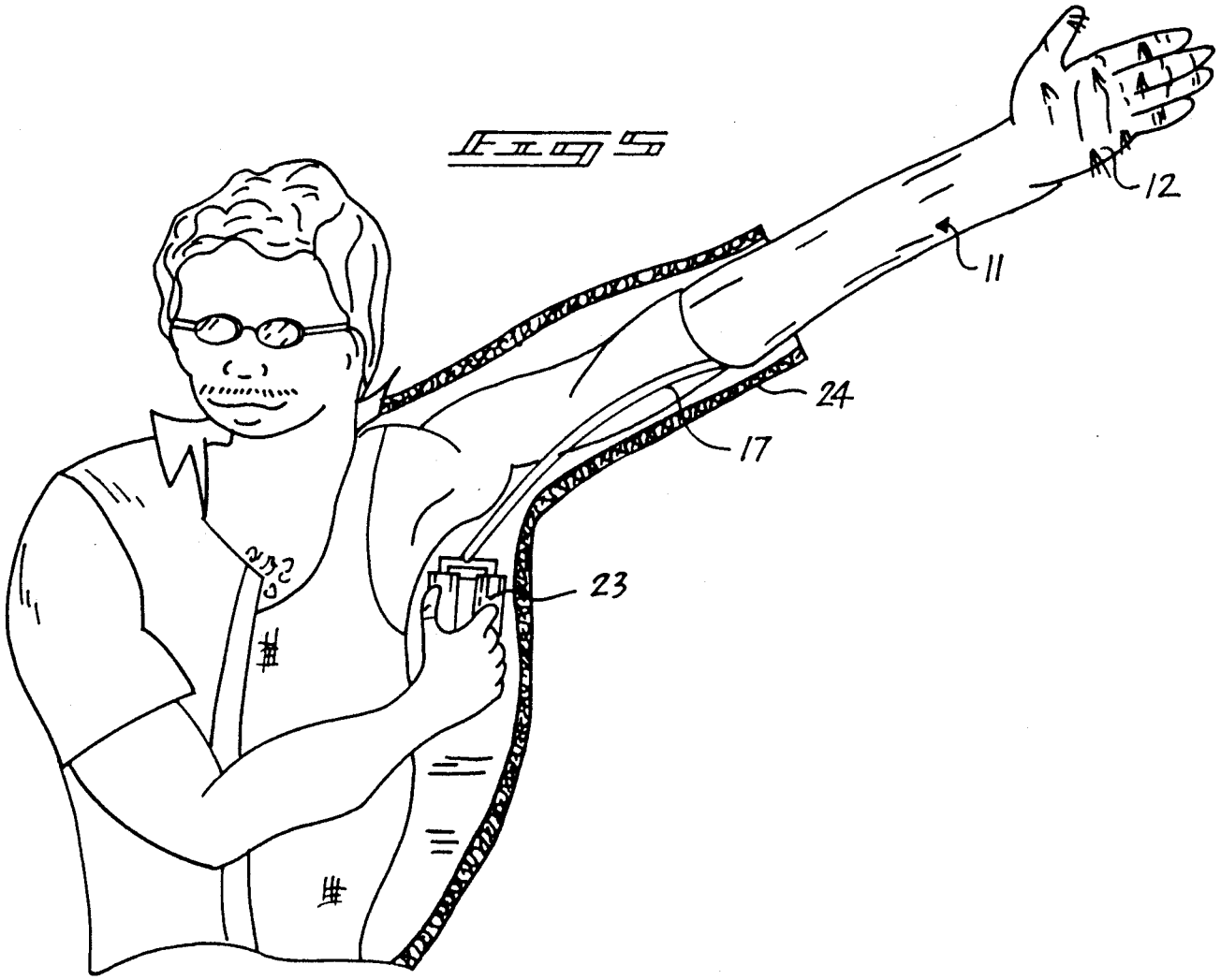
FIG. 5 is an isometric illustration of the instant invention mounted relative to an individual's nature limb.

FIG. 5 illustrates the organization mounted within an individual's shirt and directed through the shirt sleeve 24 mounted upon an individual's natural limb. A pneumatic pump 23 is illustrated in use as an alternative to the pressurized container 19.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by LETTERS PATENT of the United States is as follows:

1. An artificial limb apparatus comprising, in combination, an elongate, flexible tubular sleeve member formed of a memory retentent material, the tubular sleeve member including an entrance opening formed at a first end of the tubular sleeve member, and a hand portion mounted to a remote second end of the tubular sleeve member, and wherein the sleeve member includes an outer tube and an inner tube defining a pneumatic chamber coextensive with the sleeve member and hand portion, and the outer tube formed of a porous material, and the inner tube formed of a fluid impermeable material, and pump means to direct atomized and pressured fluid within the pneumatic chamber.

2. An apparatus as set forth in claim 1 wherein the pump means includes an elongate, pneumatic conduit directed through the pneumatic chamber, the pneumatic conduit including a series of conduit apertures directed throughout the conduit within the pneumatic chamber, and the pump means further including a pressurized pneumatic container mounted to the pneumatic conduit remote from the tubular sleeve member.

3. An apparatus as set forth in claim 2 wherein the pneumatic container includes a securement cap removably mounted to the pneumatic container, the securement cap includes a selectively operative valve to direct pressure from within the container through the pneumatic conduit, and the securement cap further includes a refill valve mounted in the cap to effect pressurizing of the container subsequent to mounting of the cap on the container.

* * * * *